US009370256B2

(12) United States Patent
Chien Chen

(10) Patent No.: US 9,370,256 B2
(45) Date of Patent: Jun. 21, 2016

(54) BABY CRIB

(71) Applicant: Ching-Ying Chien Chen, Kaohsiung (TW)

(72) Inventor: Ching-Ying Chien Chen, Kaohsiung (TW)

( * ) Notice: Subject to any disclaimer, the term of this patent is extended or adjusted under 35 U.S.C. 154(b) by 74 days.

(21) Appl. No.: 14/524,537

(22) Filed: Oct. 27, 2014

(65) Prior Publication Data

US 2016/0113413 A1 Apr. 28, 2016

(51) Int. Cl.
*A47D 7/02* (2006.01)
*A47D 9/00* (2006.01)

(52) U.S. Cl.
CPC ... *A47D 7/02* (2013.01); *A47D 9/00* (2013.01)

(58) Field of Classification Search
CPC ..... A47D 7/00; A47D 7/002; A47D 7/005; A47D 7/03; A47D 7/02; A47D 9/00
See application file for complete search history.

(56) References Cited

U.S. PATENT DOCUMENTS 845,384 A * 2/1907 Vallone ..... A47D 7/002 5/100
2,459,445 A * 1/1949 McClintock ..... A47D 7/002 5/98.3
2,844,828 A * 7/1958 Stark ..... A47C 17/1655 5/425
3,032,154 A * 5/1962 McNabb, Jr. ..... A47D 7/03 192/16
3,900,907 A * 8/1975 Mulder ..... A47D 7/02 312/257.1
4,924,539 A * 5/1990 Benoit ..... A47D 7/02 5/100
5,201,085 A * 4/1993 Shamie ..... A47D 7/02 5/100
6,256,813 B1 * 7/2001 Aaron ..... A47C 21/046 5/100
6,651,275 B1 * 11/2003 Rummell ..... A47D 7/002 5/99.1
6,817,046 B1 * 11/2004 Srour ..... A47D 13/065 5/100
7,415,740 B1 * 8/2008 Kemper ..... A47D 7/02 5/100
2012/0073044 A1 * 3/2012 Lake ..... A47D 7/002 5/99.1
2012/0102641 A1 * 5/2012 Srour ..... A47D 7/03 5/93.1
2012/0186375 A1 * 7/2012 Sack ..... A47D 7/03 74/101
2013/0097775 A1 * 4/2013 Littlefield ..... A47D 7/03 5/93.1
2013/0198957 A1 * 8/2013 Obriot ..... A47D 7/007 5/604
2015/0033473 A1 * 2/2015 Wu ..... A47C 23/155 5/93.1

* cited by examiner

*Primary Examiner* — David E Sosnowski
*Assistant Examiner* — Eric Kurilla
(74) *Attorney, Agent, or Firm* — Muncy, Geissler, Olds & Lowe, P.C.

(57) ABSTRACT

A baby crib includes a bedstead, a mattress bracket and four bridging sets. The bedstead includes two longitudinal brackets and two widthwise brackets. The mattress bracket includes two longitudinal frames, two widthwise frames and four arched frames. Each bridging set includes a bridging plank and a detent member. Each bridging plank is hinged on one widthwise frame and swivelable in parallel therewith during packaging and transportation, and the detent member can be retracted toward each arched frame. Each widthwise bracket has a plurality of adjustment holes. Each bridging plank has a plurality of positioning holes and a fastener to selectively run through anyone of the positioning holes to lean on a bottom surface of each widthwise frame so that users can do adjustment manually to anchor the bedstead in the event that the hole interval of any adjustment hole of each widthwise bracket is slightly shrunk.

4 Claims, 19 Drawing Sheets

BABY CRIB

FIELD OF THE INVENTION

The present invention relates to a bed and particularly to a baby crib that can be shrunk in a smaller size and is selectively adjustable in assembly and foldable.

BACKGROUND OF THE INVENTION

A conventional crib bedstead 1, please referring to FIG. 1, generally includes two opposing longitudinal brackets 23 and two opposing widthwise brackets 21 that are coupled to form a bedstead 20 with a space 22, a bottom bracket 30 located in the space 22 and four bridging planks 40 to bridge the bedstead 20 and the bottom bracket 30. Each bridging plank 40 includes a leaning end 41 hinged on one of two opposite width edges 32 of each widthwise bracket 21 and a fastening end 42 fastened to each widthwise bracket 21. The leaning end 41 leans on a detent member 31 fastened to each width edge 32 close to a distal end of each longitudinal bracket 23 so that the bridging plank 40 can be anchored on the bedstead 20 and the bottom bracket 30. Although the aforesaid implementation approach provides the bridging plank 40 to bridge the bedstead 20 and the bottom bracket 30, for packaging and transportation, with the detent member 31 directly fastened to each width edge 32 of each widthwise bracket 21 to be leaned by the leaning end 41 of each bridging plank 40, the leaning end 41 is easily hindered by the detent member 31 and unable to swivel in parallel with the width edge 32 for folding. As a result the bedstead 30 is bulky in size and takes a huge space in packaging and transportation. To resolve this problem, another approach is unfastening and separating the detent member 31 from the bridging plank 40, and fastening them again onsite. Although such a practice can reduce the space needed for packaging and transportation, the bridging planks 40 and the detent members 31 are small size elements, and packaged them separately also makes losing of them easier that could result in final assembly impossible.

Please also referring to FIGS. 2A and 2B, on the aforesaid crib bedstead 1 each widthwise bracket 21 has a surface 210 faced each longitudinal bracket 23 that has a plurality of apertures 211 formed thereon in column to be fastened by the fastening end 42 of each bridging plank 40, while the leaning end 41 is hinged on the bottom bracket 30. The apertures 211 on each widthwise brackets 21 are spaced from each other at an interval which could have variations during fabrication. As long as the variations are within an allowance range of safety regulations for children use, they are acceptable. But if the spaced interval of the apertures 211 on the widthwise brackets 21 is shrunk from a first aperture interval 24 to a second aperture interval 25 the fastening end 42 of each bridging plank 40 could not be accurately aligned with and fastened to each aperture 211 of the widthwise bracket 21 that could result in lifting of the bridging plank 40. Trying to accurately align the fastening end 42 with the aperture 211 could make the leaning end 41 unable to lean on the detent member 31 that could produce a gap 33 between the bridging plank 40 and the detent member 31, this would result in swaying of the bedstead 20.

SUMMARY OF THE INVENTION

The primary object of the present invention is to solve the problems of the conventional crib bedstead of using unfoldable bridging planks that result in a bulky bottom bracket which takes a lot of space, and an fastening end of the bridging planks not adjustable to make accurate alignment and fastening needed by shrinking of aperture intervals of the bedstead to conform to the safety regulations for children use.

To achieve the foregoing object the present invention provides a baby crib which includes a bedstead, a mattress bracket and four bridging sets. The bedstead includes two opposing longitudinal brackets and two opposing widthwise brackets that are coupled to form an installation space among them. Each widthwise bracket has a first surface faced each longitudinal bracket that has a plurality of adjustment holes at one end thereof. The mattress bracket is installed in the installation space, and includes two longitudinal frames, two widthwise frames and four arched frames. Each widthwise frame has two ends each having a hinge hole formed thereon faced each widthwise bracket. Each bridging set includes a bridging plank to bridge one widthwise bracket and each widthwise frame of the mattress bracket, and a detent member bent toward the mattress bracket and connected to each bridging plank to allow the bridging plank to lean on a bottom surface of each widthwise frame. Each bridging plank includes a first aperture faced one of the adjustment holes of each widthwise bracket, a second aperture faced one of the hinged holes, a first fastener run through the first aperture and fastened to one of the adjustment holes, and a second fastener run through the second aperture and hinged in one of the hinged holes to allow the bridging plank to swivel leftward or rightward. Thereby each bridging plank is hinged on one widthwise frame and movable in parallel therewith for packaging and transportation, and foldable for storing, and the detent member can be retracted toward each arched frame without jamming.

In one embodiment the first aperture and the second aperture of each bridging plank form a long side section between them, and the second aperture and the detent member form a short side section between them.

In another embodiment each bridging plank includes a plurality of spaced positioning holes on the short side section to face one widthwise frame, and a fastener run through one of the positioning holes and leaned on the bottom surface of the widthwise frame.

In yet another embodiment each fastener has a thread portion and a detent strut leaned on one short side section to anchor the short side section on one widthwise frame. The positioning holes are screw holes each can be screwed with the thread portion of the fastener.

Through the structure set forth above, compared with the conventional techniques, the invention provides many advantages, notably:

1. The detent member can lean on the bottom surface of each widthwise frame to make assembly of the baby crib firmer. Each bridging plank can be swiveled in parallel with one widthwise frame, and the detent member can be retracted toward each arched frame during folding without jamming to shrink the size of the mattress bracket, thereby packaging and transportation of the baby crib are much easier.

2. Since each widthwise bracket has a plurality of adjustment holes formed thereon, in the event that the adjustment hole interval shrinks slightly, the fastener can be selectively inserted into a suitable positioning hole to lean each bridging plank on the bottom surface of the widthwise frame to enable users do adjustment manually to anchor the bedstead.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
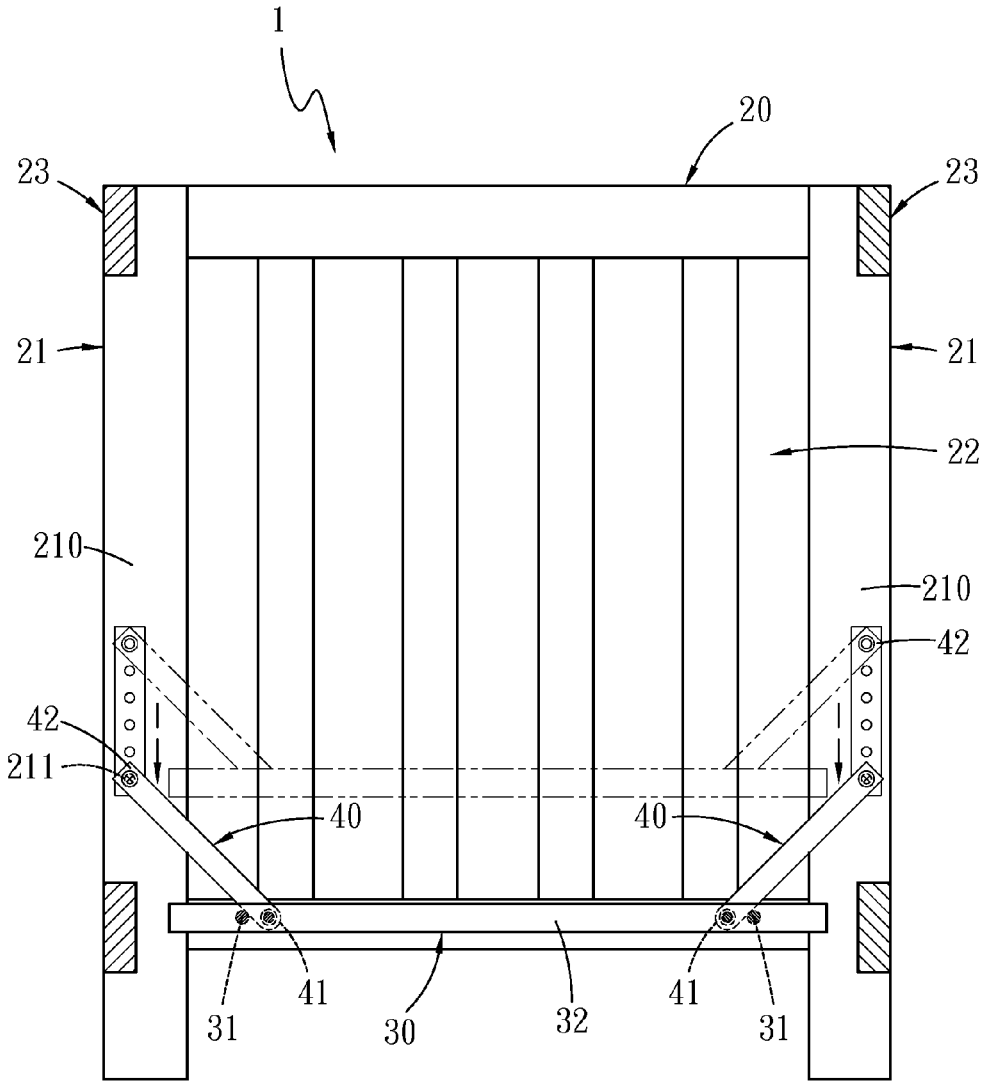
Fig. 1 PRIOR ART
FIG. 1 is a schematic view of a conventional crib bedstead for adjusting the elevation of a bottom bracket.
Figure 2A:
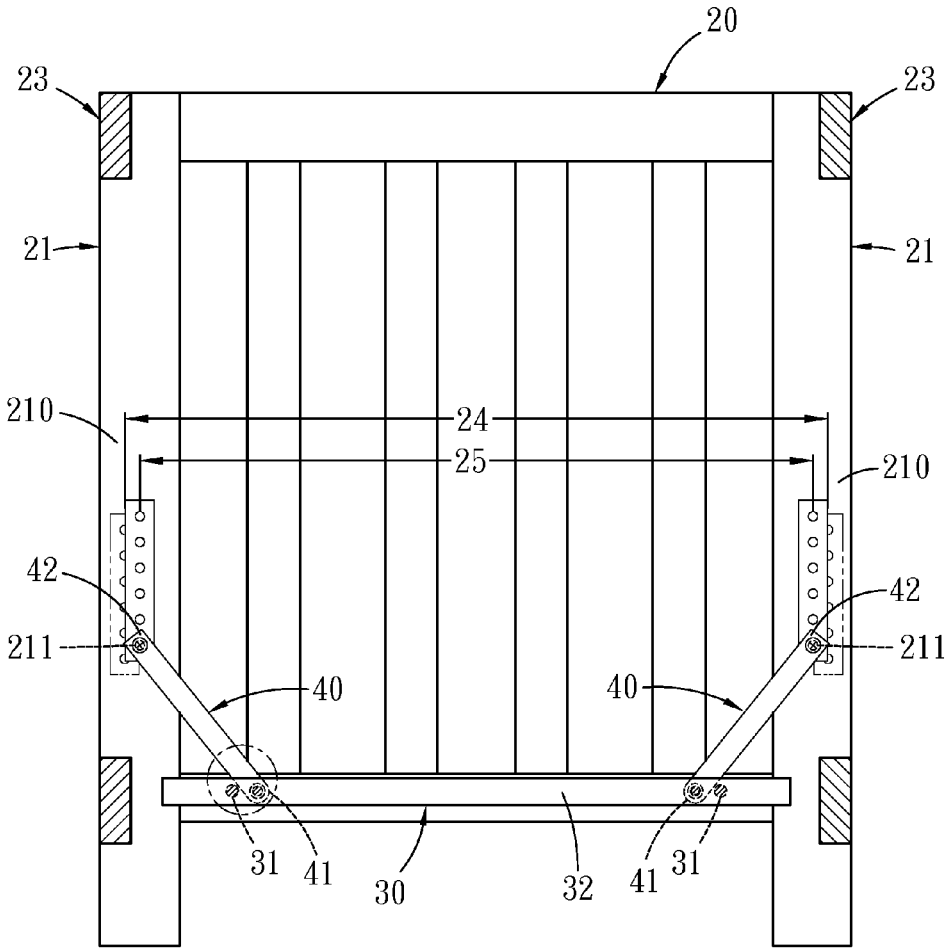
Fig. 2A PRIOR ART
FIG. 2A is a schematic view of a conventional crib with a gap formed between a bridging plank and a detent member.
Figure 2B:
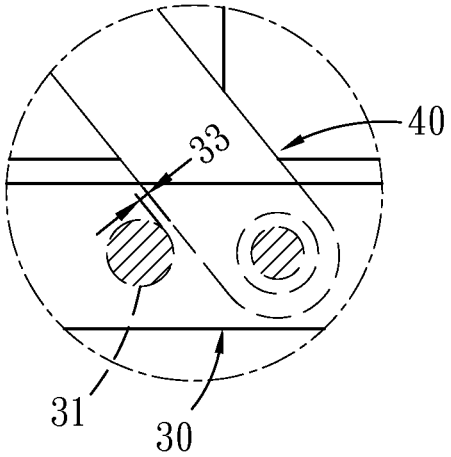
Fig. 2B PRIOR ART
FIG. 2B is a fragmentary enlarged view of FIG. 2A.
Figure 3:
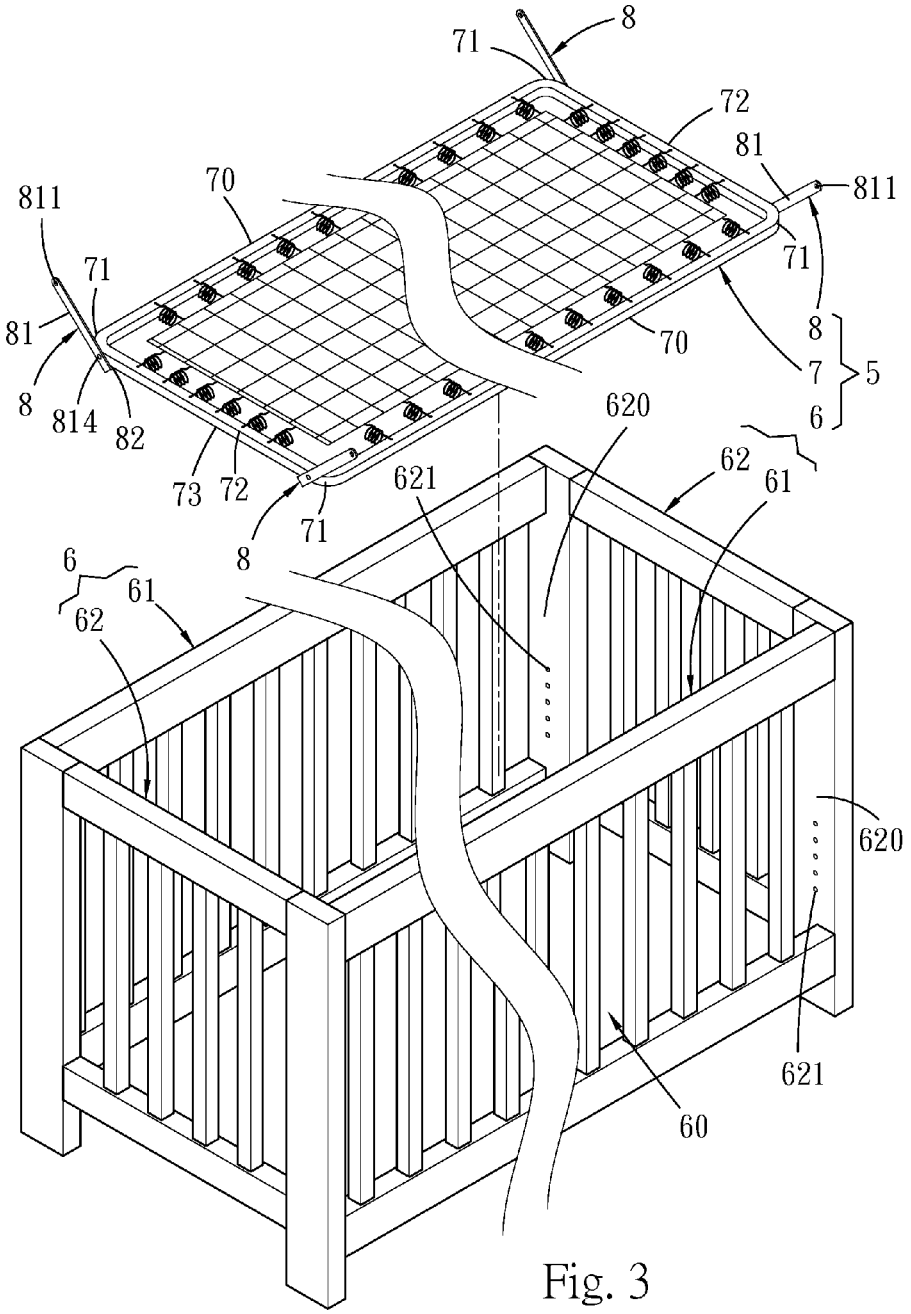
FIG. 3 is an exploded view of the baby crib of the invention.
Figure 4:
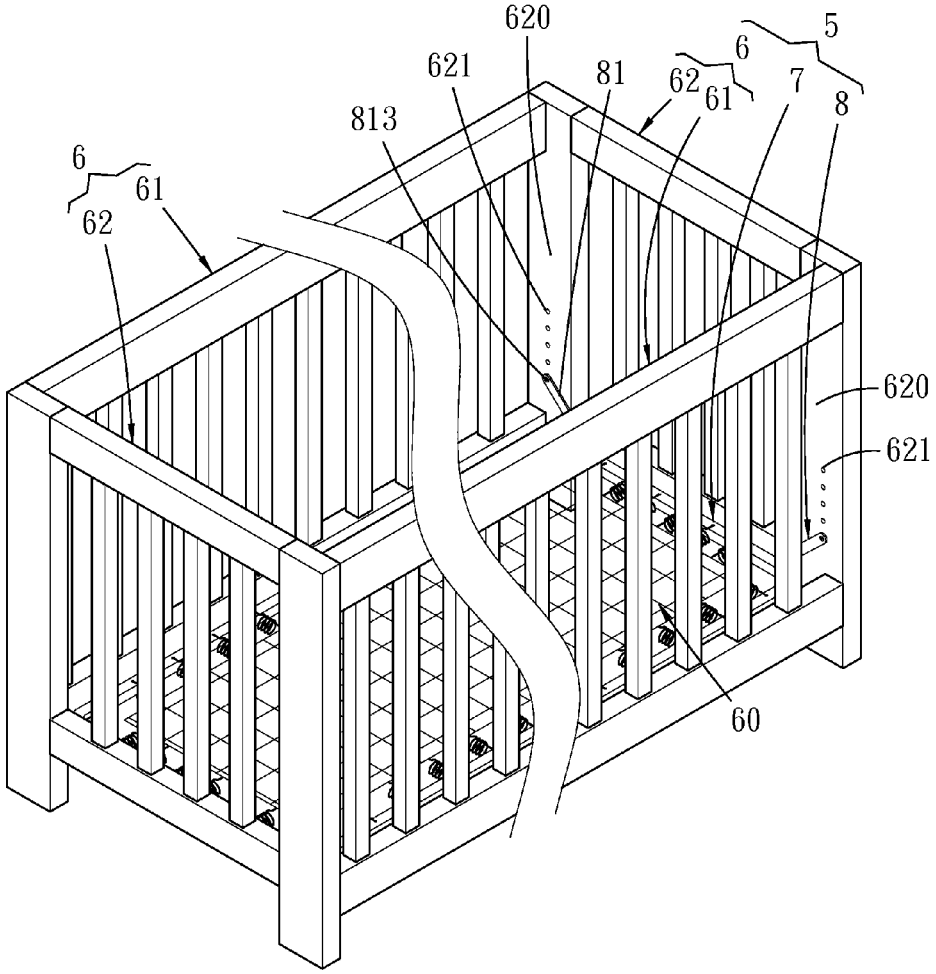
FIG. 4 is a perspective view of the baby crib of the invention.
Figure 5:
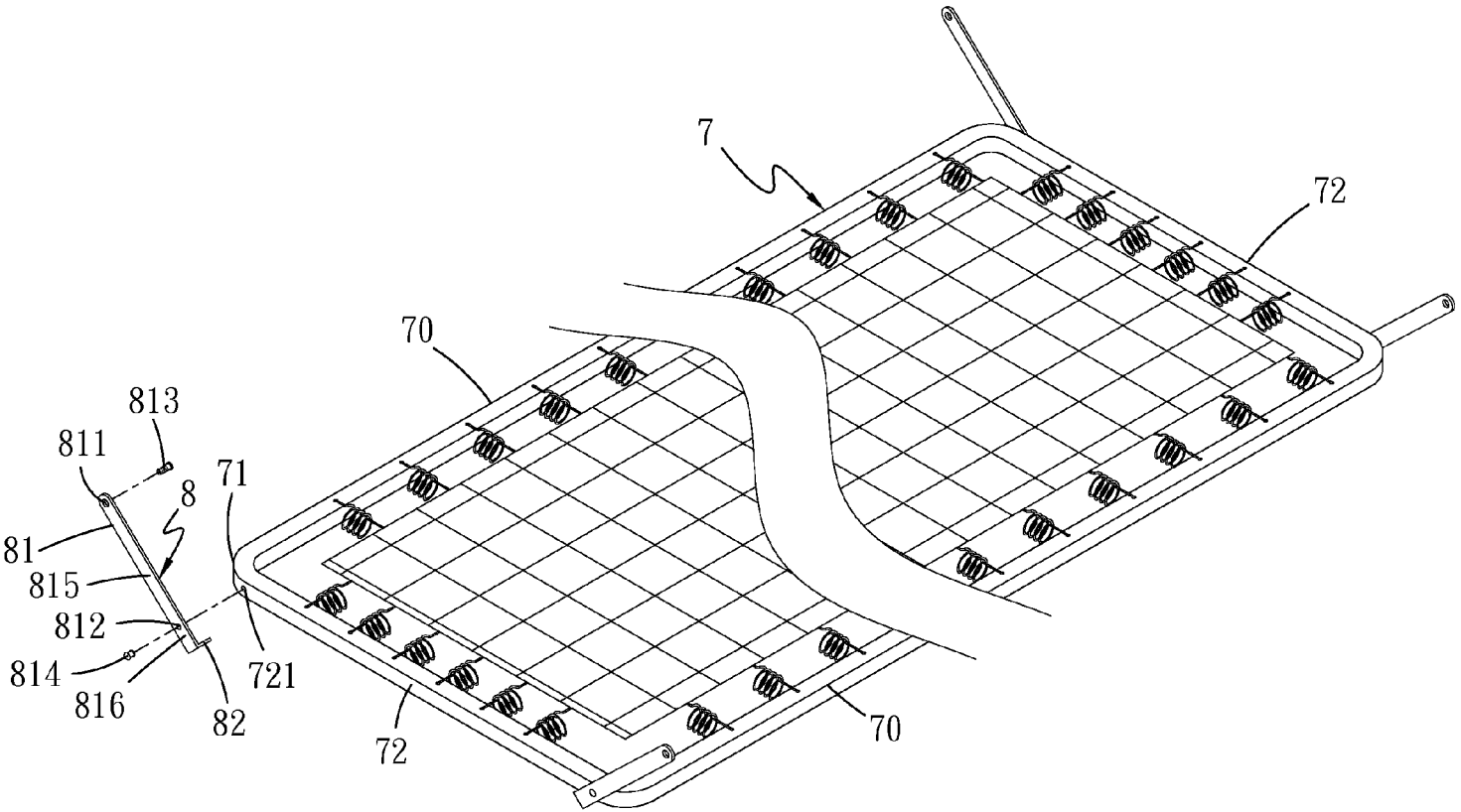
FIG. 5 is an exploded view of the mattress bracket and a bridging set of the invention.
Figure 6A:
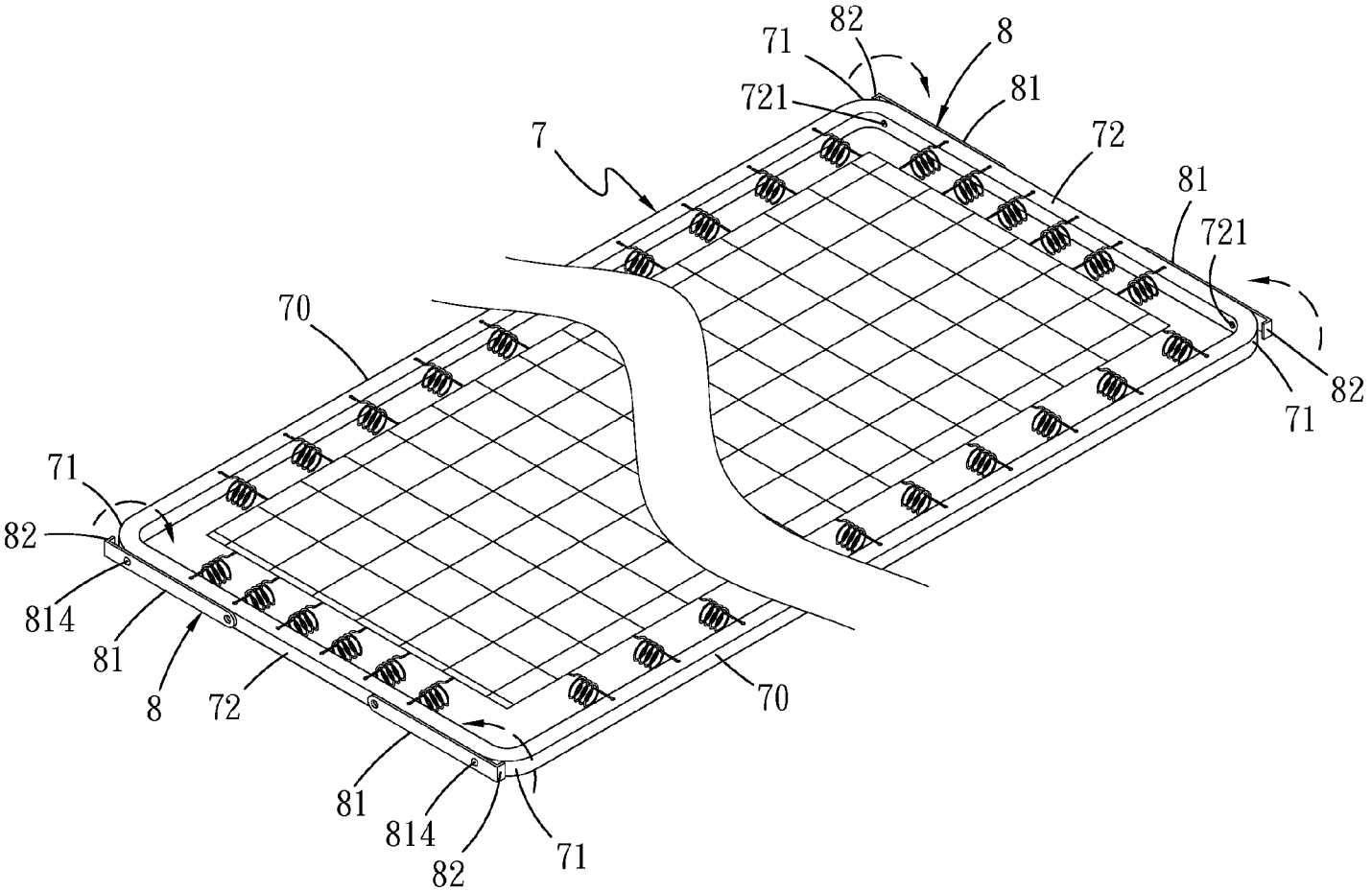
FIG. 6A is a perspective view according to FIG. 5 with the bridging set in a retracting condition.
Figure 6B:
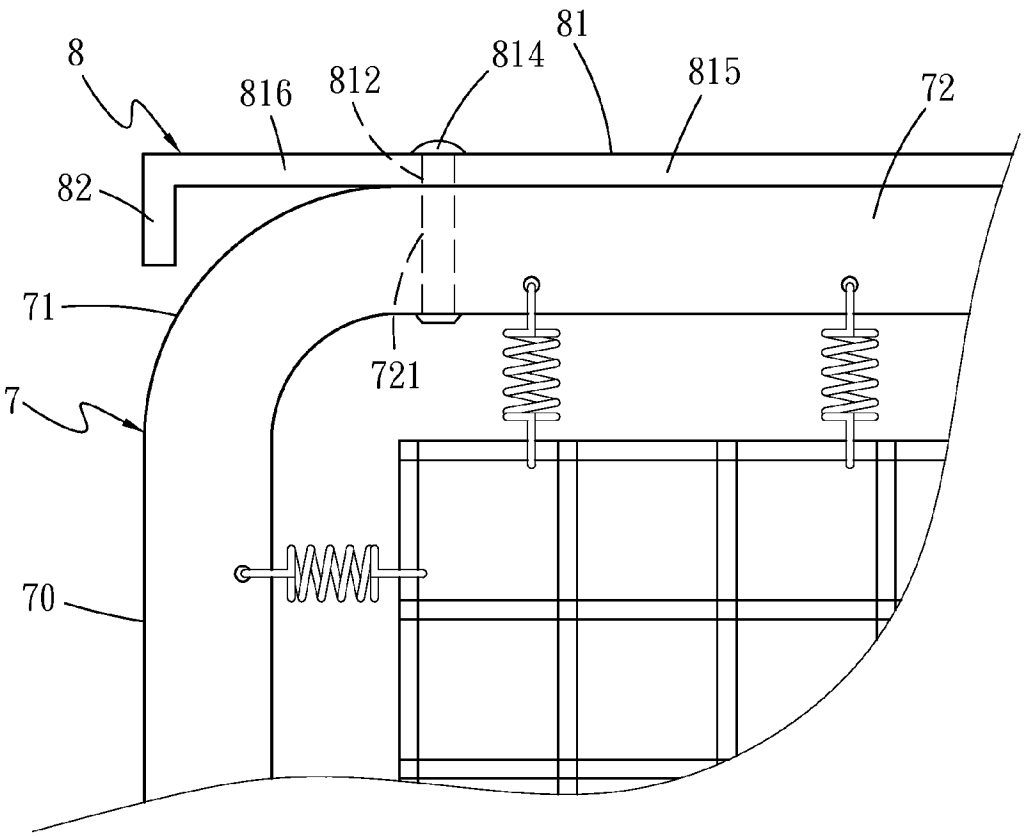
FIG. 6B is a fragmentary enlarged view of FIG. 6A with the bridging set in the retracting condition.

Please referring to FIGS. 3 through 5, the present invention aims to provide a baby crib 5 that includes a bedstead 6, a mattress bracket 7 and four bridging sets 8. The bedstead includes two opposing longitudinal brackets 61 and two opposing widthwise brackets 62 that are coupled to form an installation space 60 among them. In this embodiment each widthwise bracket 62 has a first surface faced 620 faced one longitudinal bracket 61 that has a plurality of adjustment holes 621 formed at one end thereof. The adjustment holes 621 are spaced from each other regularly, but this is not the limitation of the invention. The mattress bracket 7 is installed in the installation space 60 and includes two longitudinal frames 70, two widthwise frames 72 corresponding to each longitudinal frame 70, and four arched frames 71 each bridges one longitudinal frame 70 and one widthwise frame 72. Each widthwise frame 72 has two ends each having a hinge hole 721 formed thereon faced each widthwise bracket 62. Each bridging set 8 includes a bridging plank 81 to bridge one widthwise bracket 62 and the mattress bracket 7, and a detent member 82 bent toward the mattress bracket 7 and connected to the bridging plank 81 to allow the bridging plank 81 to lean on a bottom surface 73 of each widthwise frame 72. In this embodiment each bridging plank 81 includes a first aperture 811 faced anyone of the adjustment holes 621, a second aperture 812 faced one of the hinged holes 721, a first fastener 813 run through the first aperture 811 and fastened to one of the adjustment holes 621, and a second fastener 814 run through the second aperture 812 and hinged in one of the hinged holes 721 to allow the bridging plank 81 to swivel leftward or rightward. The first aperture 811 and the second aperture 812 of each bridging plank 81 form a long side section 815 between them, and the second aperture 812 and the detent member 82 form a short side section 816 between them. The fastener 813 is a screw. The second fastener 814 is a rivet. Also referring to FIGS. 6A and 6B, each bridging plank 81 can be swiveled toward one widthwise frame 72 in parallel therewith, and also can be folded and retract the detent member 82 toward one arched frame 71 without being jammed by the widthwise frame 72, thereby can shrink the size of the mattress bracket 7 to reduce the package size of the mattress bracket 7 to facilitate transportation and stacking.

Figure 7A:
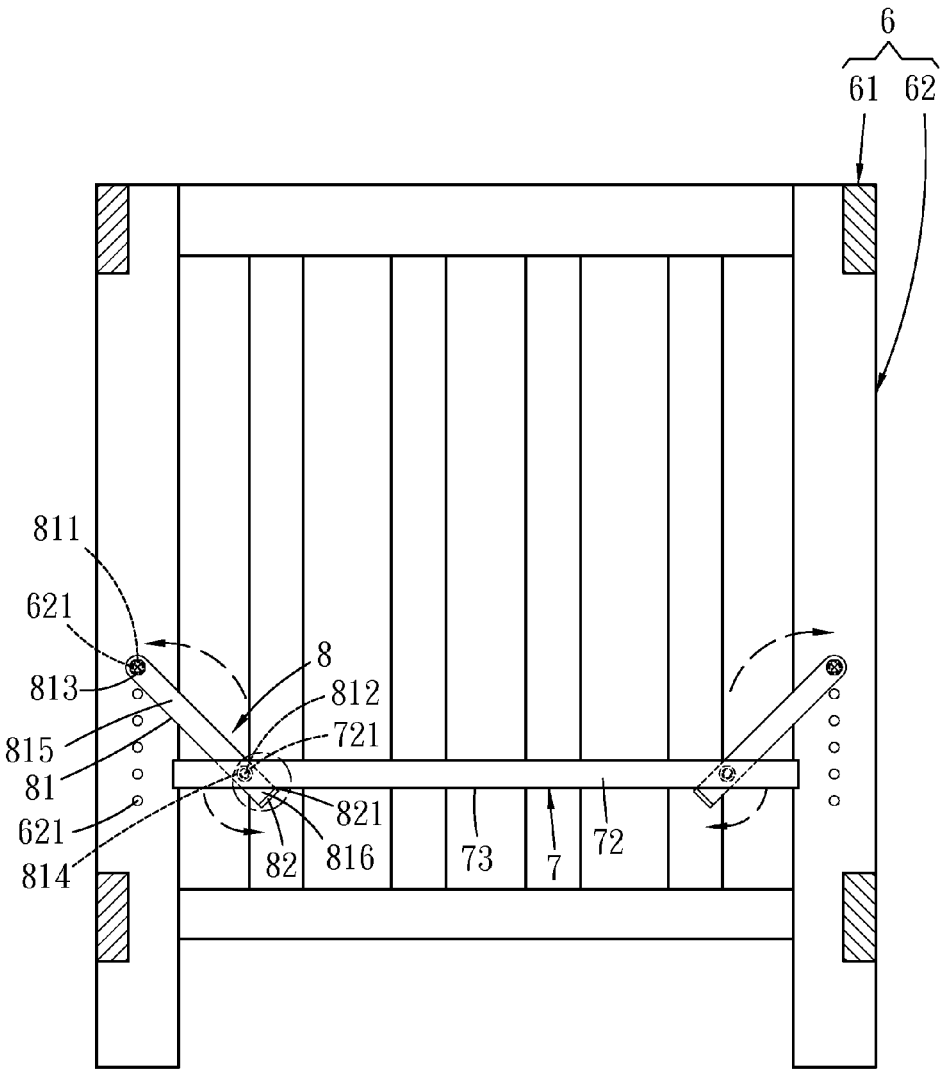
FIG. 7A is a schematic view of the mattress bracket and the bridging sets adjusted for assembly according to the invention.
Figure 7B:
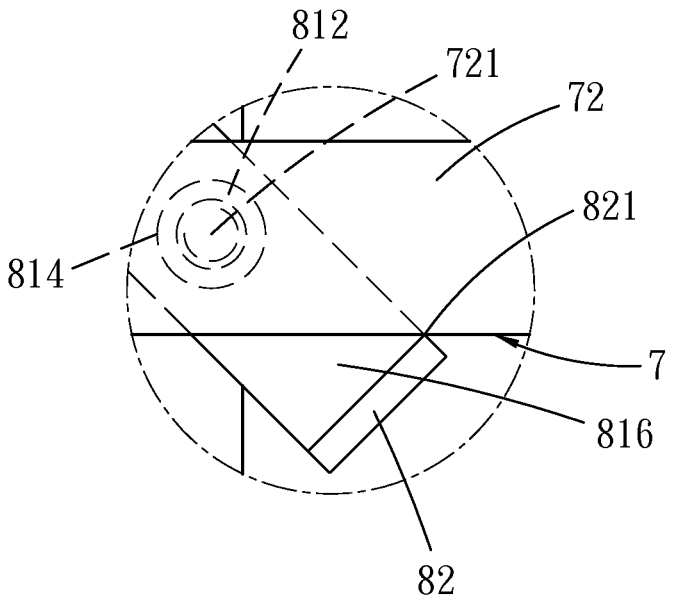
FIG. 7B is a fragmentary enlarged view of FIG. 7A.
Figure 8:
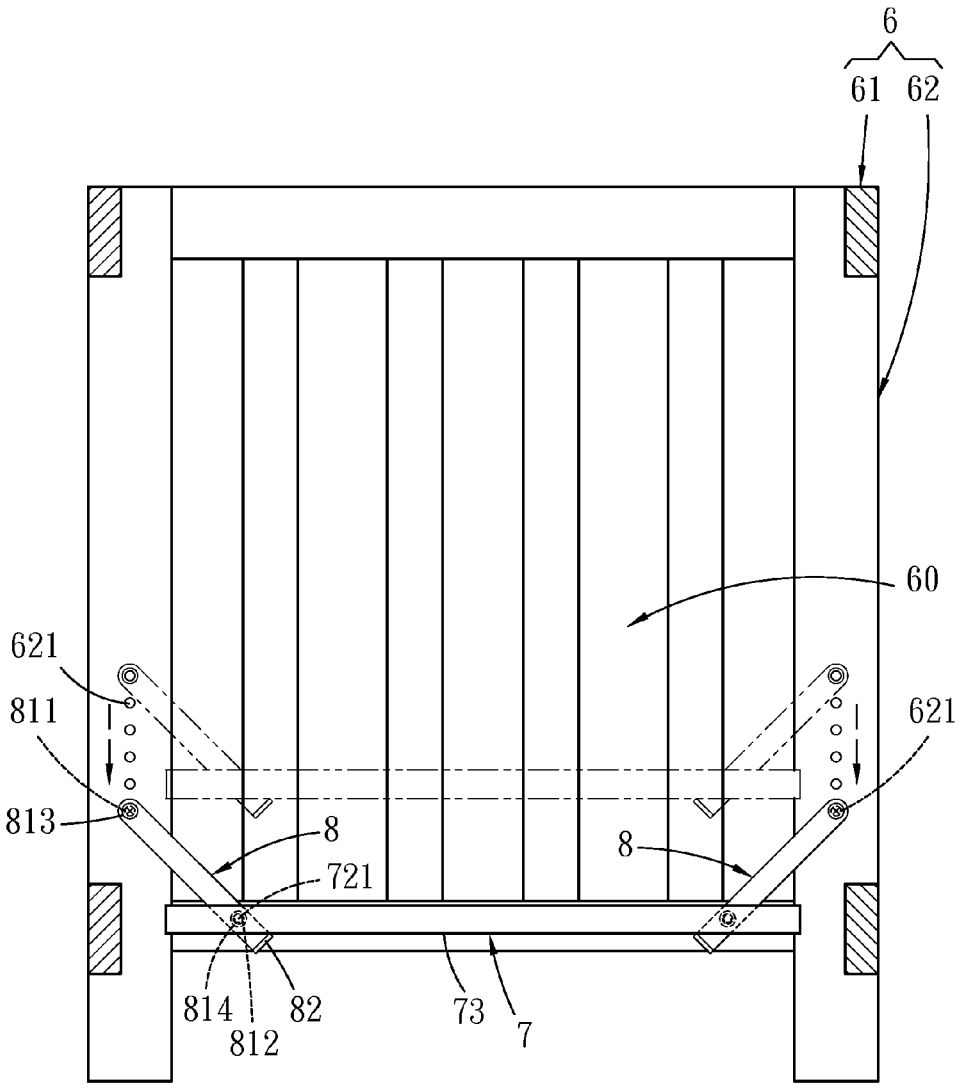
FIG. 8 is a schematic view of the invention showing the mattress bracket moved downward.

Also referring to FIGS. 4, 7A and 7B, the mattress bracket 7 can be installed in the installation space 60 of the bedstead 6. Each first fastener 813 can run through the first aperture 811 of one bridging plank 81 to fasten to anyone of the adjustment holes 621 on each widthwise bracket 62, then each second fastener 814 can run through the second aperture 812 to be hinged on one of the hinge holes 721. The second fastener 814 serves as an axis of the bridging plank 81 to swivel leftward or rightward, thereby can adjust the relative position of the bridging plank 81 and anyone of the adjustment holes 621 of each widthwise bracket 62; meanwhile, the detent member 82 has a detent end 821 leaned on the bottom surface 73 of the widthwise frame 72 so that the mattress bracket 7 can be securely installed in the installation space 60 of the bedstead 6. In addition, when the detent end 821 of the detent member 82 leans on the bottom surface 73 of the widthwise frame 72 the mattress bracket 7 and the bedstead 6 form a maximum gap 74 between them (referring to FIG. 12A) so that users can adjust the elevation position of the mattress bracket 7 in the installation space 60 according to a child's grow condition (referring to FIG. 8).

In the event that during production a slight inaccuracy takes place and results in the spaced interval between each adjustment hole 621 and the first aperture 811 shrunk from an original first hole interval 63 to a smaller second hole interval 64, referring to FIGS. 9 through 11B, and makes the first aperture 811 of the bridging plank 81 not aligned exactly with each adjustment hole 621 of the widthwise bracket 62, the bridging plank 81 has to be swiveled slightly to align the first aperture 811 with the adjustment hole 621; however, the bottom surface 73 of the widthwise frame 72 is moved away from the detent end 821 of the detent member 821 to form a gap 9 between them. To avoid the bedstead 6 from swaying because of the gap 9 when a child is moved on the mattress bracket 6, a plurality of spaced positioning holes 817 are formed on the short side section 816 faced each widthwise frame 72 and a fastener 83 is provided to run through one positioning hole 817 and lean on the bottom surface 73 of the widthwise frame 72. In addition, the fastener 83 can be selectively run through anyone of the positioning holes 817 close to the second fastener 814 to lean on the bottom surface 73, so that a minimum gap 75 is formed between the mattress bracket 7 and the bedstead 6 (referring to FIG. 12A). Thereby swaying of the mattress bracket 6 can be reduced to make the bedstead 6 steadier. This also can facilitate elevation adjustment of the mattress bracket 7 in the event that a slight inaccuracy of adjustment holes 621 occurred that makes the hole interval relative to the bedstead 6 not fully complying with the safety regulation range for children use. The faster 83 includes a thread portion 831 and a detent strut 832 leaned on the short side section 816 of the bridging plank 81 to anchor the short side section 816 on each widthwise frame 72. The positioning hole 817 is a screw hole screwed with the thread portion 831 of the fastener 83.

Figure 9:
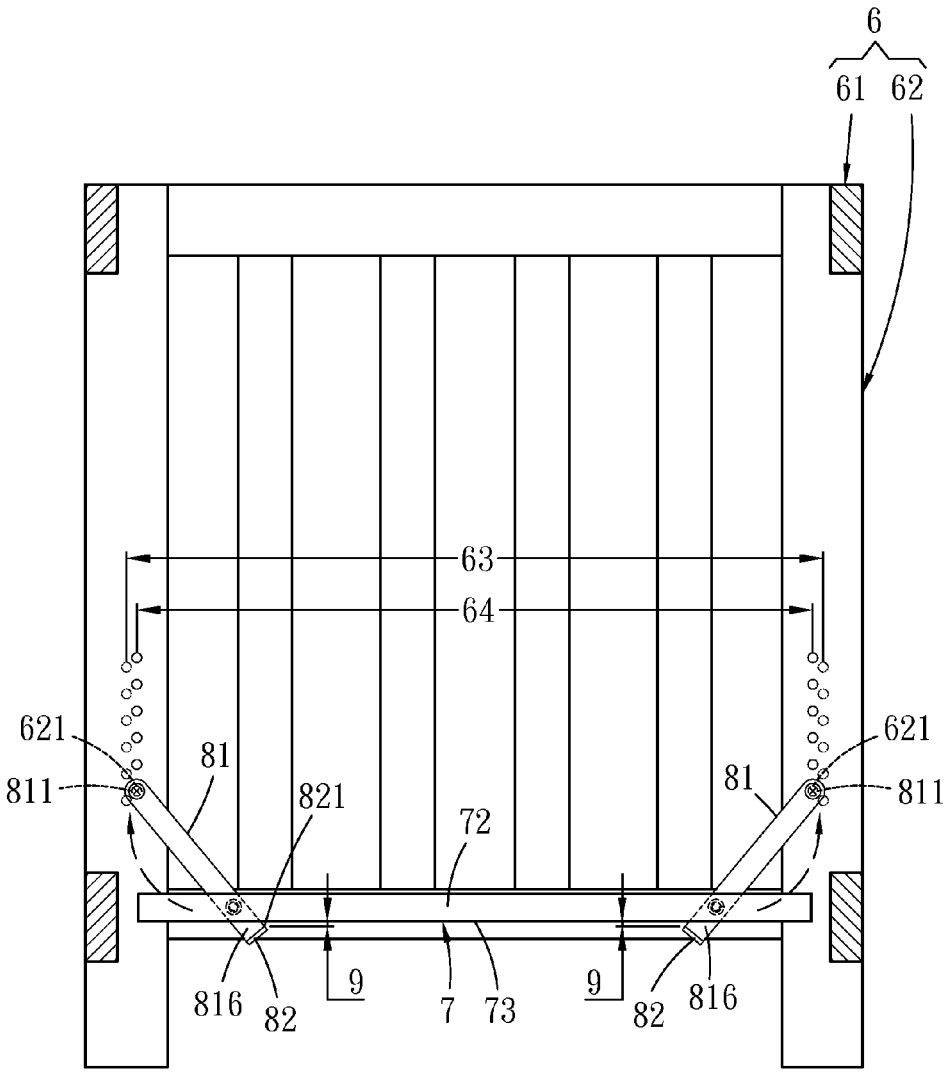
FIG. 9 is a schematic view of the invention showing the bedstead and the mattress bracket bridged via the bridging sets.
Figure 10:
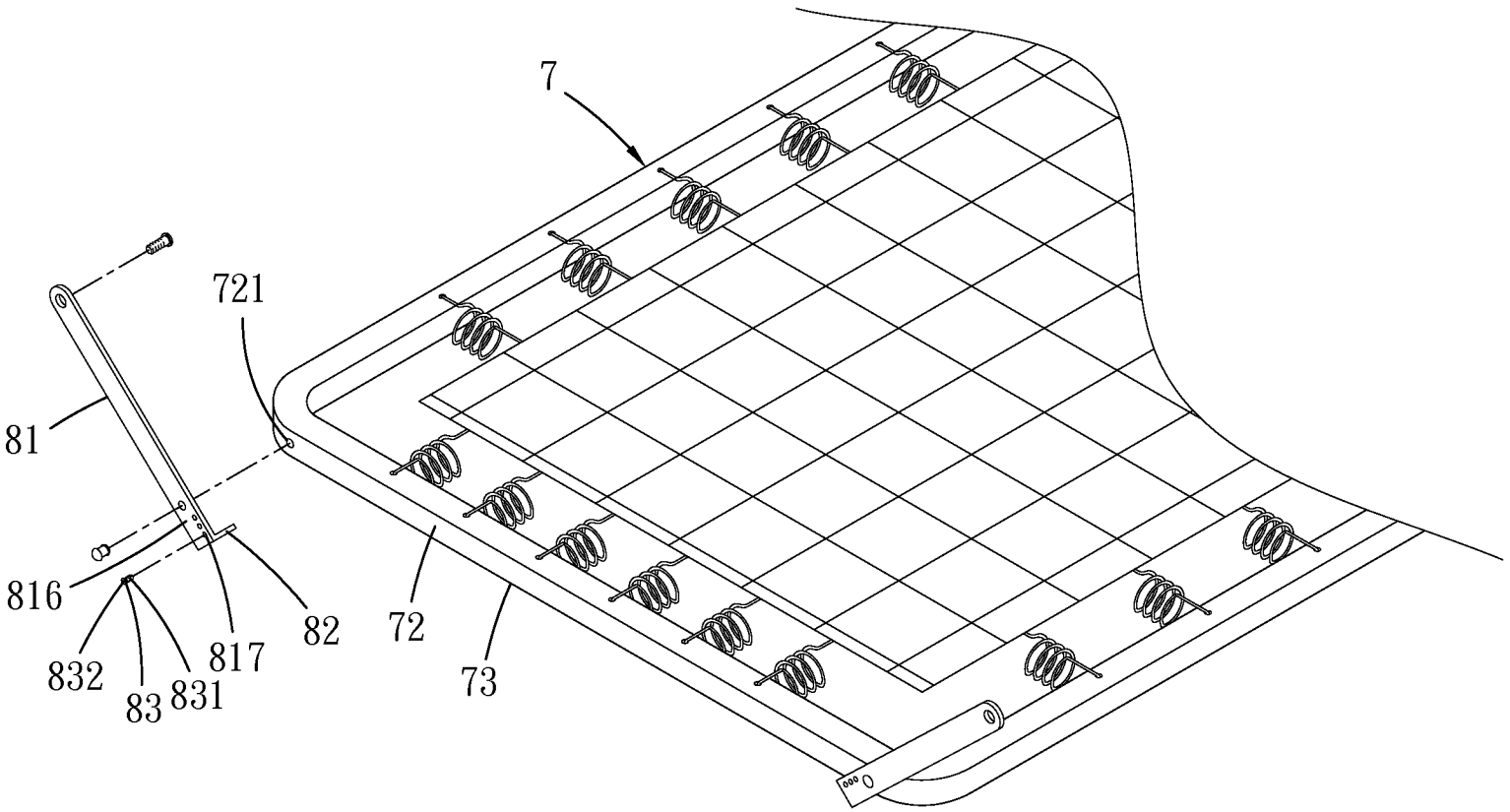
FIG. 10 is an exploded view of another embodiment of the bridging plank of the invention.
Figure 11A:
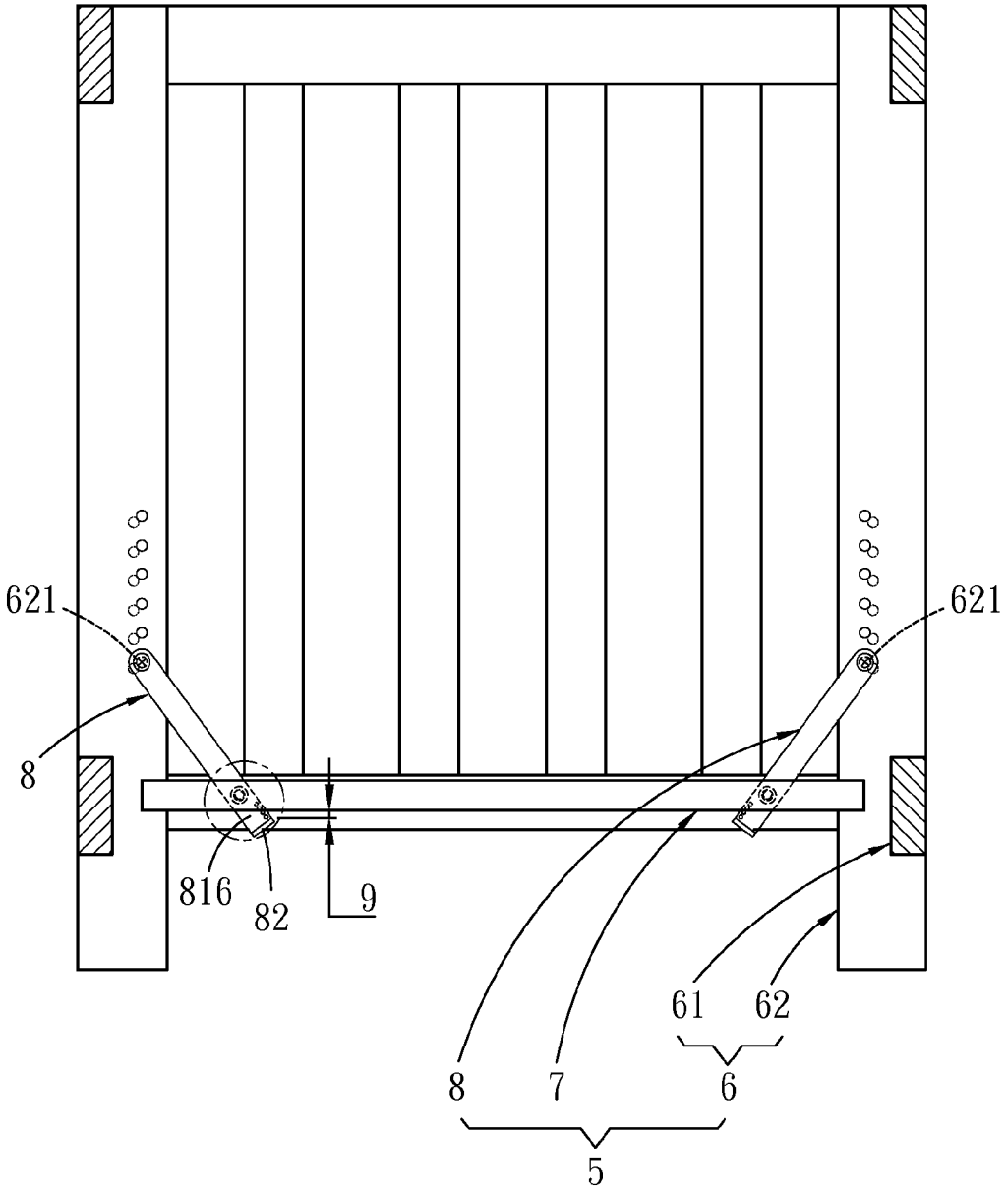
FIG. 11A is a schematic view according to FIG. 10 with the bridging planks and the mattress bracket in a coupling condition.
Figure 11B:
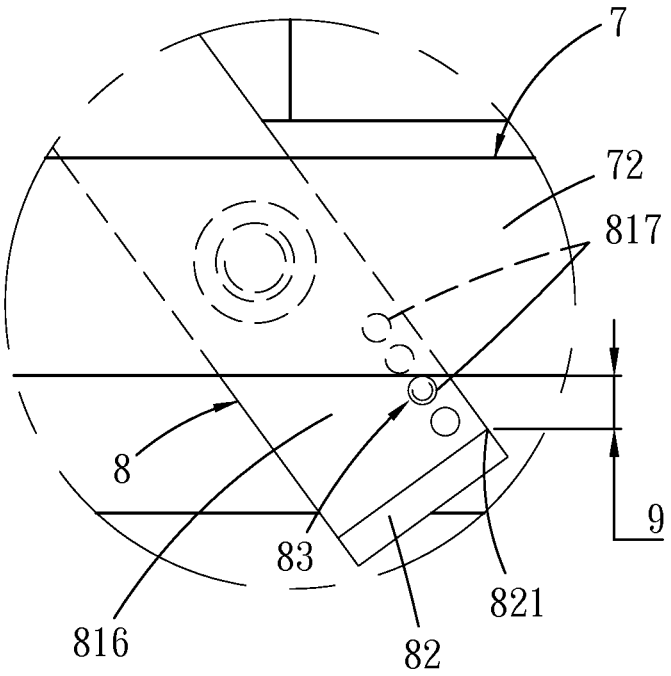
FIG. 11B is a fragmentary enlarged view of FIG. 11A.
Figure 12A:
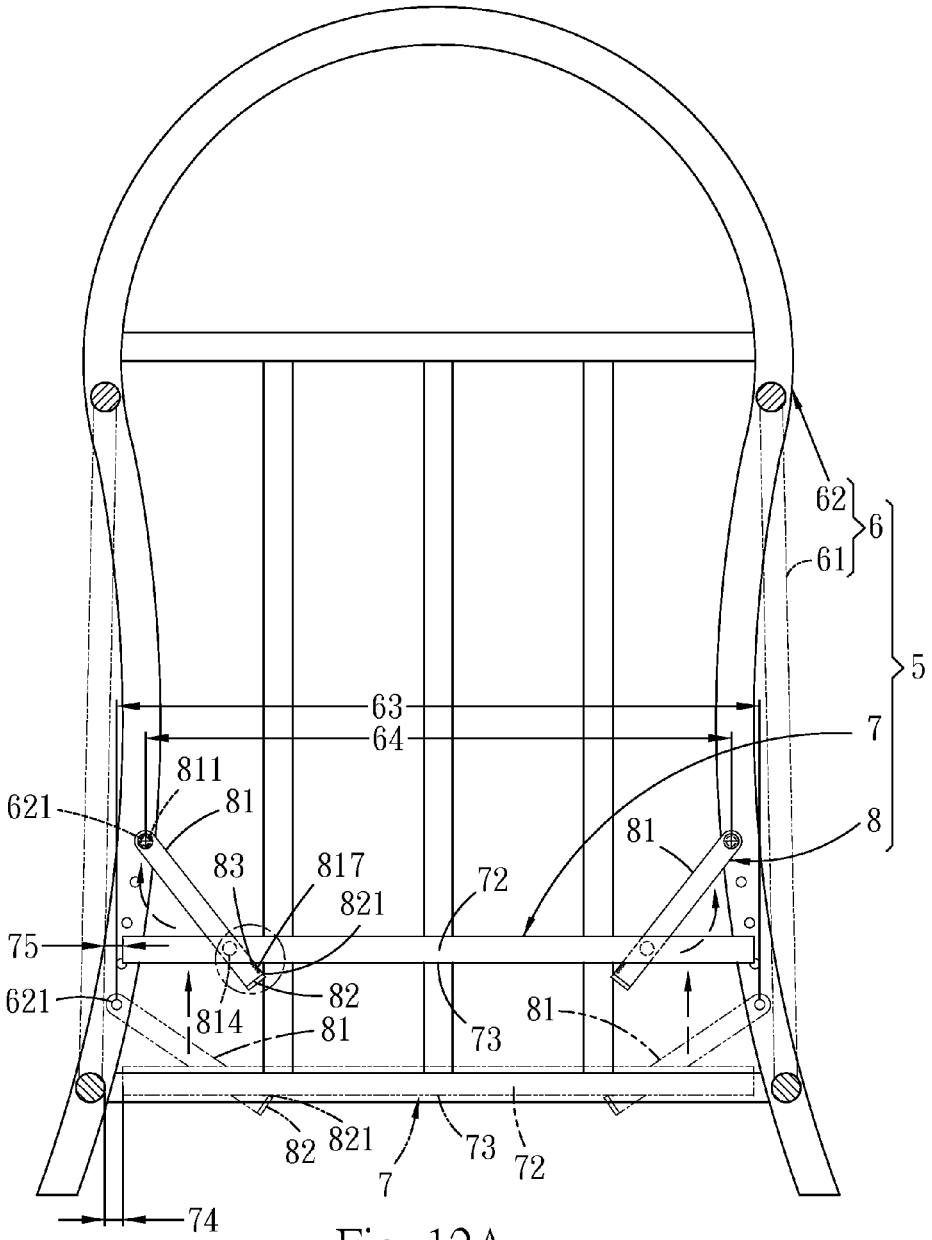
FIG. 12A is a schematic view of the invention showing an arched bedstead and the bridging sets in assembly and adjustment conditions.
Figure 12B:
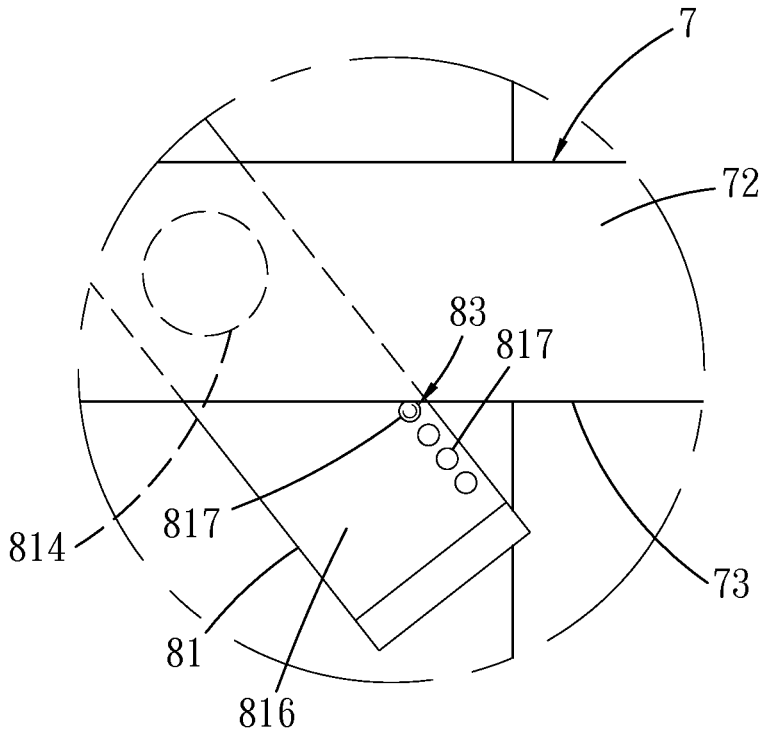
FIG. 12B is a fragmentary enlarged view of FIG. 12A.
Figure 13A:
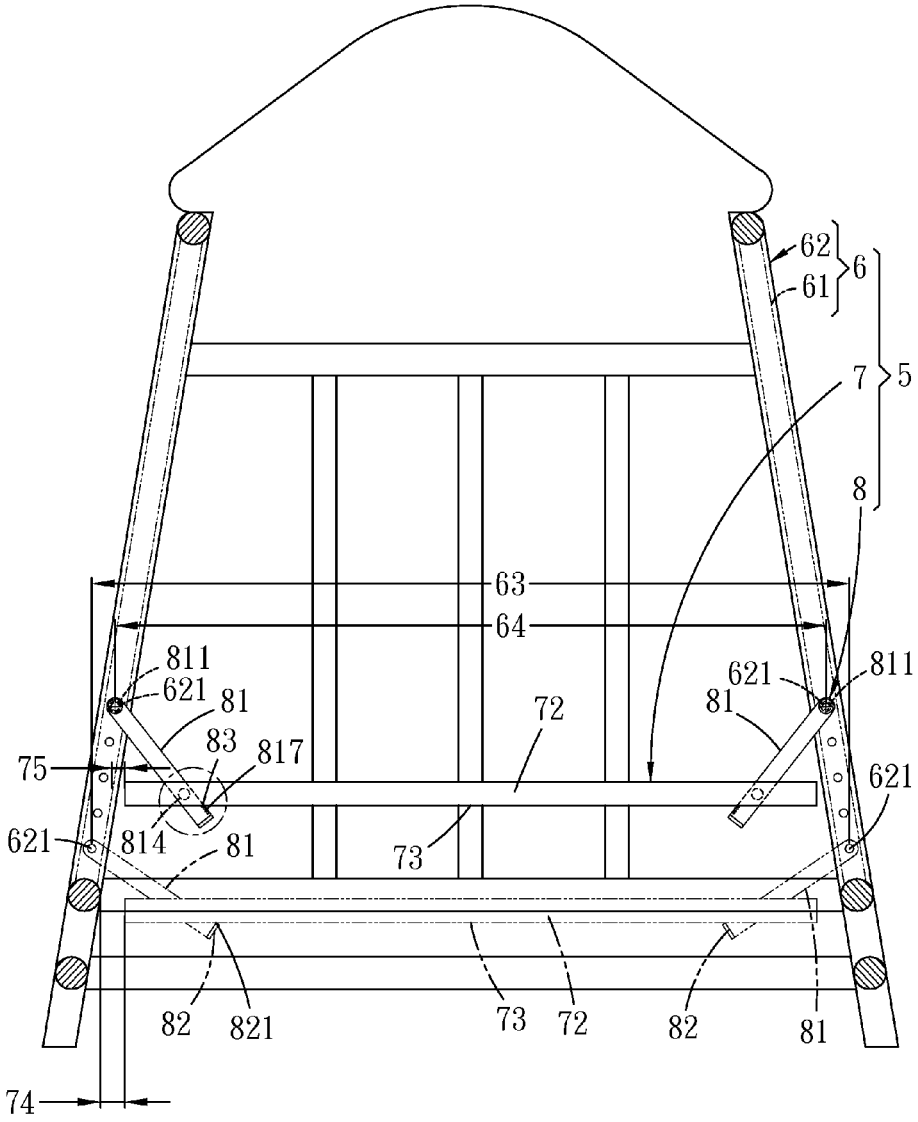
FIG. 13A is a schematic view of the invention showing an inclined bedstead and the bridging sets in assembly and adjustment conditions.
Figure 13B:
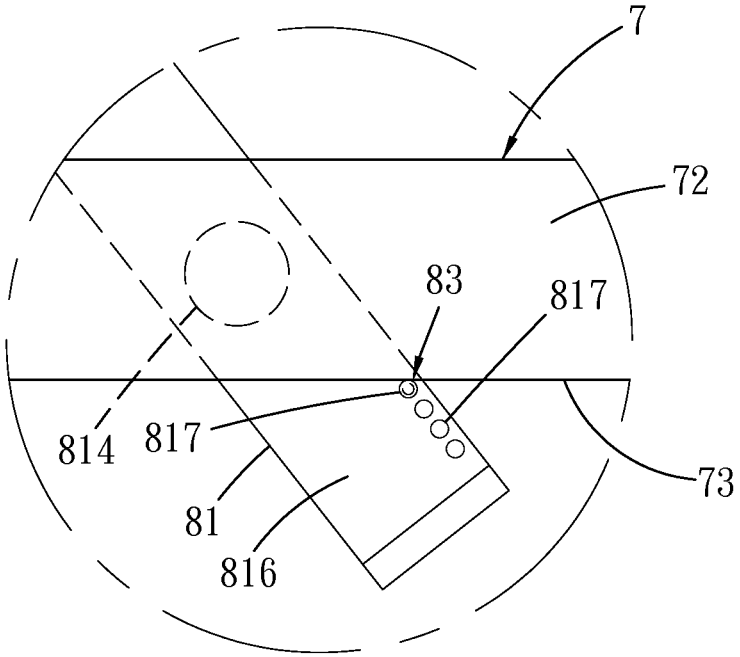
FIG. 13B is a fragmentary enlarged view of FIG. 13A.

In other embodiments of the baby crib 5 the bedstead 6 can be formed in varying styles via coupling of the bridging planks 81 with the mattress bracket 7. FIGS. 12A and 12B illustrate one of the embodiments in which each widthwise bracket 62 is formed in an arched shape, while FIGS. 13A and 13B show another embodiment in which each widthwise bracket 62 is formed in an inclined manner so that the adjustment holes 621 on the widthwise bracket 62 also are arranged in an arched or inclined fashion, with varying hole intervals between the adjustment holes 621 as shown in FIG. 9. Also referring to FIGS. 12A and 13A, due to fabrication inaccuracy the first hole interval 63 between the adjustment holes 621 is shrunk to the second hole interval 64, in order to make the maximum gap 74 between the widthwise frame 72 and the widthwise bracket 62 to conform to the safety regulations for children use, an adjustment can be made by aligning the first aperture 811 of the bridging plank 81 with one of adjustment holes 621 to make the detent end 821 of the detent member 82 leaned on the bottom surface 73 of the widthwise frame 72, thereby the mattress bracket 7 can be securely installed in the installation space 60 of the bedstead 6. To make the widthwise frame 72 and the widthwise bracket 62 to space from each other at the minimum gap 75 to conform to the safety regulations for children use, the aperture 811 of each bridging plank 81 can be aligned with one of the adjustment holes 621, and the positioning hole 817 close to the second fastener 814 can be run through by the fastener 83 to lean on the bottom surface 73 of the widthwise frame 72 to reduce swaying of the bedstead 6 and make the bedstead 6 steadier.

What is claimed is:

1. A baby crib, comprising:

a bedstead including two opposing longitudinal brackets and two opposing widthwise brackets that are coupled to form an installation space, each widthwise bracket including a first surface which includes plurality of adjustment holes at one end thereof facing each longitudinal bracket;

a mattress bracket which is installed in the installation space and includes two longitudinal frames, two widthwise frames corresponding to each longitudinal frame and four arched frames to bridge respectively each longitudinal frame and each widthwise frame, each widthwise frame including a hinge hole at one of two ends thereof facing each widthwise bracket; and four bridging sets each including a bridging plank to bridge one widthwise bracket and one widthwise frame, and a detent member connected to each bridging plank and bent toward the mattress bracket to allow the bridging plank to lean on a bottom surface of each widthwise frame; each bridging plank including a first aperture facing any one of the adjustment holes and a second aperture facing the hinge hole, a first fastener run through the first aperture and fastened to any one of the adjustment holes, and a second fastener run through the second aperture and hinged in the hinge hole to control each bridging plank to swivel leftward or rightward so that the bridging plank hinged on each widthwise frame is swivelable in parallel with the widthwise frame during packaging and transportation and retracts the detent member toward each arched frame during folding without jamming.

2. The baby crib of claim 1, wherein the first aperture and the second aperture of each bridging plank form a long side section therebetween, and the second aperture and the detent member form a short side section therebetween.

3. The baby crib of claim 2, wherein each bridging plank includes a plurality of spaced positioning holes on the short side section facing each widthwise frame and a fastener run through one of the positioning holes to lean on the bottom surface of the widthwise frame.

4. The baby crib of claim 3, wherein the fastener includes a thread portion and a detent strut leaned on the short side section of each bridging plank to anchor the short side section on each widthwise frame, each positioning hole being a screw hole to screw with the thread portion of the fastener.

* * * * *